United States Patent [19]

Sanner

[11] 4,286,534

[45] Sep. 1, 1981

[54] TRIMARAN SAILBOAT

[76] Inventor: Sidney N. Sanner, P.O. Box 1173, Tryon, N.C. 28782

[21] Appl. No.: 69,242

[22] Filed: Aug. 23, 1979

[51] Int. Cl.[3] ..... B63B 35/00; B63H 9/00

[52] U.S. Cl. ..... 114/39; 114/61; 114/123; 114/124; 114/90

[58] Field of Search ..... 114/56, 43, 39, 61, 114/90, 121, 123, 124, 150, 274, 281, 283, 288, 290, 292; 9/1.1, 1.7

[56] References Cited

U.S. PATENT DOCUMENTS

| | | | |
|---|---|---|---|
| 1,678,023 | 7/1928 | Stites | 114/123 |
| 2,491,746 | 7/1961 | Cunningham | 114/123 |
| 3,417,720 | 12/1968 | Covell | 114/124 |
| 3,922,994 | 12/1975 | DeLong | 114/39 |

*Primary Examiner*—Trygve M. Blix
*Assistant Examiner*—D. W. Keen
*Attorney, Agent, or Firm*—Bell, Seltzer, Park & Gibson

[57] ABSTRACT

A trimaran sailboat is provided which has the ability to limit heeling under various headings, and which includes a central hull, and a boom assembly mounted laterally across the central hull and having an outrigger hull at each end thereof. The boom assembly has an arcuate curvature along its length, and is mounted so as to permit lateral movement with respect to the central hull, so that the leeward outrigger hull may be moved outwardly from the central hull and downwardly with respect thereto, to thereby increase the leverage and buoyancy of the leeward outrigger hull.

10 Claims, 10 Drawing Figures

TRIMARAN SAILBOAT

The present invention relates to a trimaran sailboat characterized by the ability to limit heeling under various headings to thereby maximize the effective sail area and speed.

As is well recognized, sailboats tend to heel in the leeward direction from the wind forces, when either beating against the wind or on a reach. In a strong wind, such heeling significantly reduces the effective sail area and thus speed, and it also results in the hull contacting the water at an angle which increases its resistance to forward movement through the water, to further limit speed. In addition, severe heeling can result in the capsizing of a boat, or taking water over the leeward side.

Proa-like trimaran sailboats have been proposed which are intended to limit heeling, and which comprise a relatively large central hull and a pair of smaller stabilizing outrigger hulls mounted at the sides of the central hull. In one such prior sailboat, the outrigger hulls are mounted to the central hull section by means of a slide bar, whereby the outrigger hulls may be moved laterally across the central hull, note for example, the U.S. patent to Stites, No. 1,678,023.

It is an object of the present invention to provide an improved trimaran sailboat of the above general type, and which has substantial stability and provision for more effectively limiting heeling to thereby maximize the effective sail area and speed.

These and other objects and advantages of the present invention are achieved in the embodiments illustrated herein by the provision of a trimaran sailboat which comprises a central hull mounting a mast for the sail, and a boom assembly comprising a boom having an arcuate curvature along its length and an outrigger hull mounted at each end of the boom. The boom assembly is mounted laterally across the central hull and so as to permit relative lateral movement therebetween, and means are provided for selectively moving the boom assembly laterally with respect to the central hull. The boom assembly is oriented so that its center of curvature is disposed below the central hull, whereby lateral movement of the boom assembly in the leeward direction results in the leeward outrigger hull being moved outwardly from the central hull and downwardly with respect thereto, to thereby increase the leverage and buoyance of the leeward outrigger hull, and thus minimize heeling of the sailboat.

In one embodiment, the central hull is unitary and is adapted to be in buoyant contact with the water along its full length. In another embodiment, the central hull comprises a pair of longitudinally aligned and spaced apart hull sections which are mounted to the underside of a deck. Also, in this latter embodiment, one of the hull sections may be mounted for rotation about a vertical axis, and means may be provided for rotating such hull section about its vertical axis to effect steering of the sailboat.

Some of the objects having been stated, other objects will appear as the description proceeds, when taken in connection with the accompanying drawings, which are somewhat schematic in form, and in which.

Figure 1:
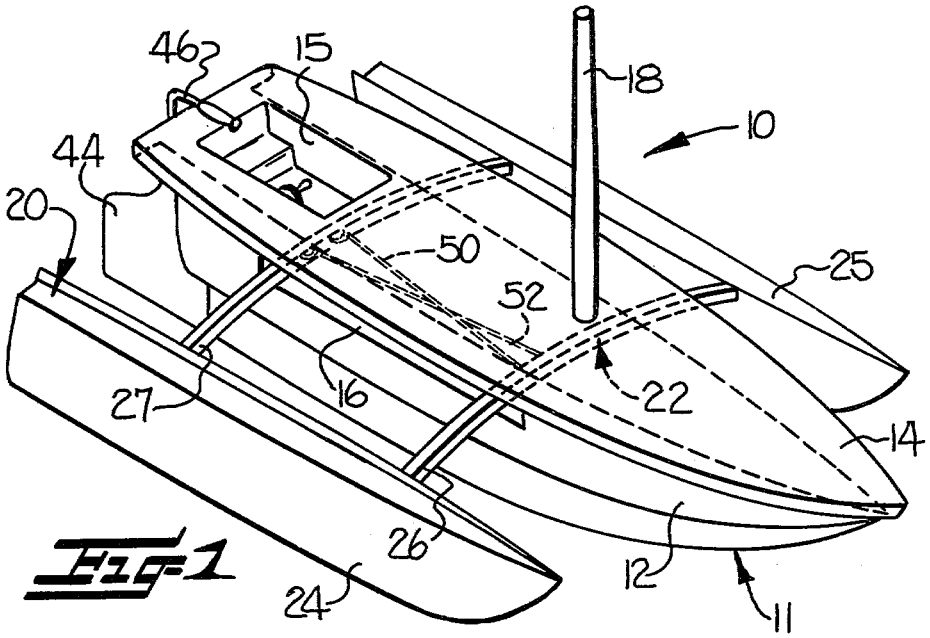
FIG. 1 is a perspective view of a sailboat embodying the features of the present invention.

Referring more specifically to the drawings, FIG. 1 illustrates a trimaran sailboat 10 which embodies the present invention. The sailboat 10 comprises a central hull 11 which includes a continuous hull surface 12 which is adapted to be in buoyant contact with the water along substantially the full length of the hull. A deck 14 overlies the surface 12, and includes a cockpit 15 formed therein at the stern for supporting the crew. Also, the central hull 11 includes a transversely directed opening 16 extending between the sides thereof and immediately below the deck, for the purposes to be described below. A mast 18 is fixed to the deck 14 for supporting a conventional sail, (not shown), and all of the conventional standing and running rigging (not shown) for the mast and sail is secured to the deck in the usual manner.

Figure 2:
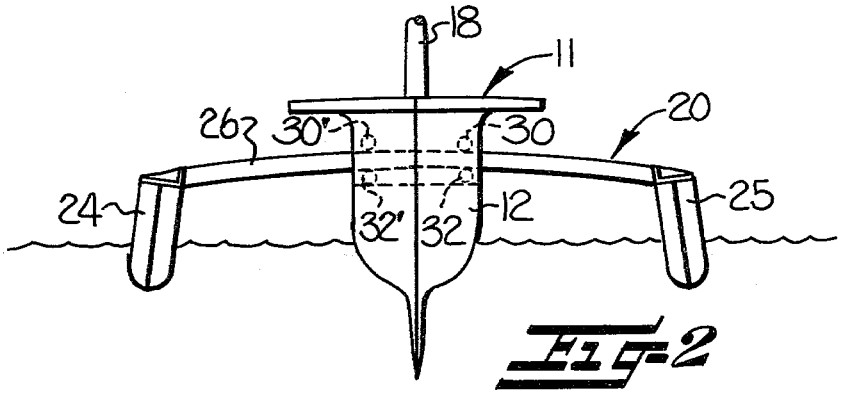
FIG. 2 is a front elevation view of the sailboat shown in FIG. 1, with the two outrigger hulls being disposed a uniform distance from opposite sides of the central hull.
Figure 3:
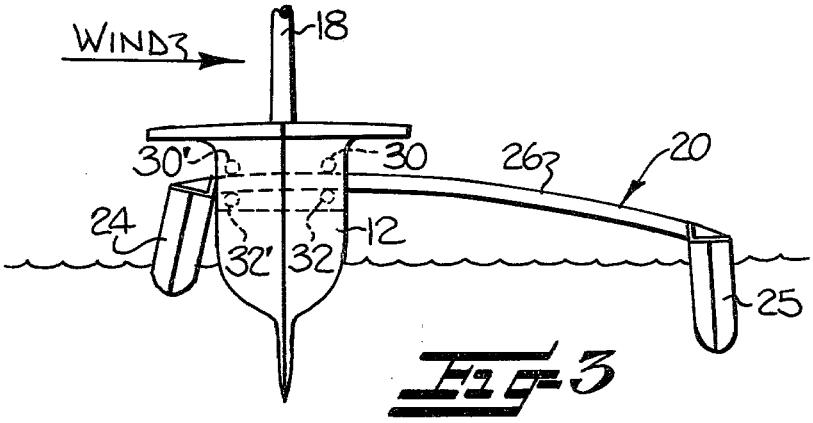
FIG. 3 is a view similar to FIG. 2, but with the leeward hull extended so as to counteract the wind forces and minimize the heeling of the central hull.
Figure 4:
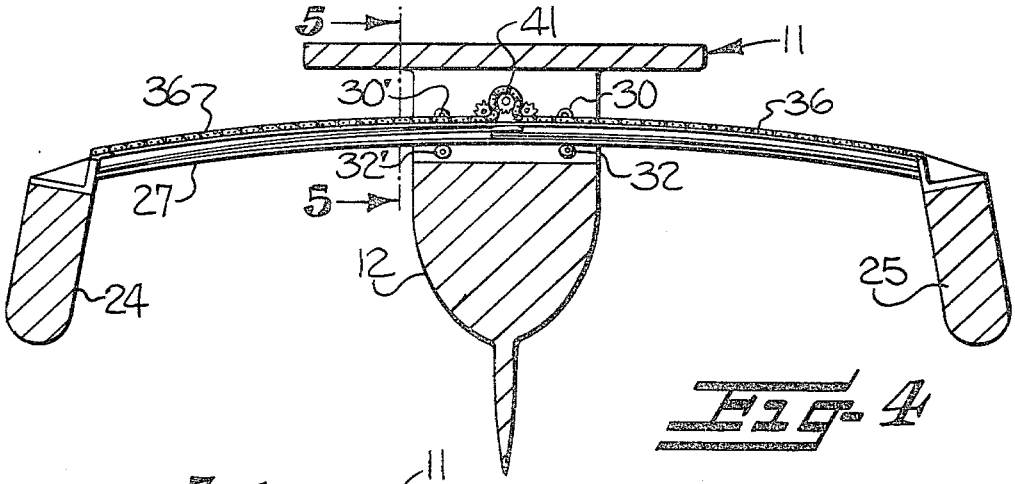
FIG. 4 is a sectional elevation view of the sailboat shown in FIG. 1 and taken along the aft cross beam of the boom assembly.
Figure 5:
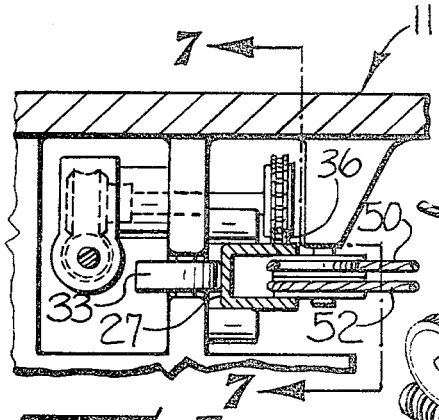
FIG. 5 is a fragmentary sectional view taken substantially along the line 5—5 of FIG. 4.

The sailboat 10 further includes a boom assembly 20 which comprises a boom 22, and outrigger hulls 24, 25 mounted at respective ends of the boom. The boom 22 is composed of a pair of elongate beams 26, 27 which are parallel to each other and spaced apart in the longitudinal direction. The beams 26, 27 are disposed laterally with respect to the central hull, and extend through the opening 16. Also, it will be seen that the two beams 26, 27 each have an arcuate curvature along their length, with the center of the curvature being disposed below the central hull 11, note FIGS. 2 and 3.

The central hull 11 and two outrigger hulls 24, 25 are fabricated, for example, from conventional fiberglass materials, and the two beams 26, 27 are preferably fabricated from lightweight metal, such as aluminum. As illustrated, the beams are in the form of U-shaped channels in cross section, and alternatively, they may take the form of metal tubing.

The boom assembly 20 is mounted to the central hull by means which permit relative lateral movement therebetween. This mounting means comprises a pair of roller assemblies mounted to the central hull 11, with one roller assembly operatively engaging each beam. One of the roller assemblies is illustrated in FIGS. 4 through 7, and comprises a pair of upper rollers 30, 30' for rotation about a horizontal axis and contacting the upper surface of the beam 27. A similar pair of lower rollers 32, 32' contact the lower surface of the beam, and a third pair of rollers 33, 33' are mounted to the central hull for rotation about a vertical axis and contact a side face of the beam. The pairs of vertical rollers 33, 33' of the two roller assemblies respectively contact opposing sides of the two beams 26, 27, to preclude longitudinal movement between the deck assembly and hull assembly.

Figure 6:
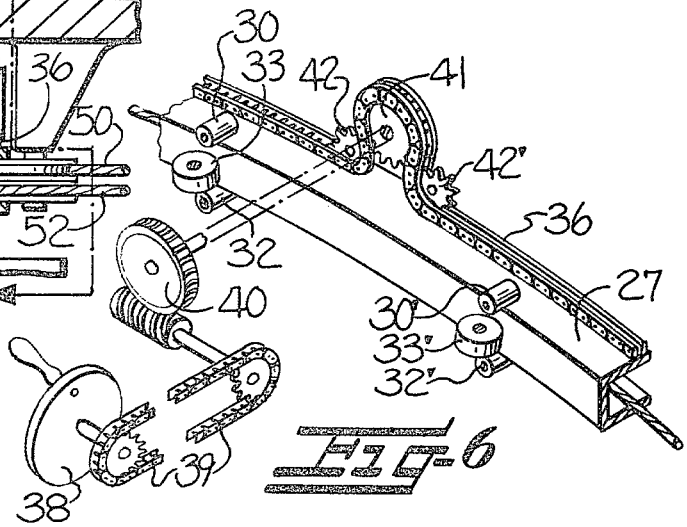
FIG. 6 is a fragmentary perspective view of the means for laterally moving the boom assembly with respect to the central hull.
Figure 7:
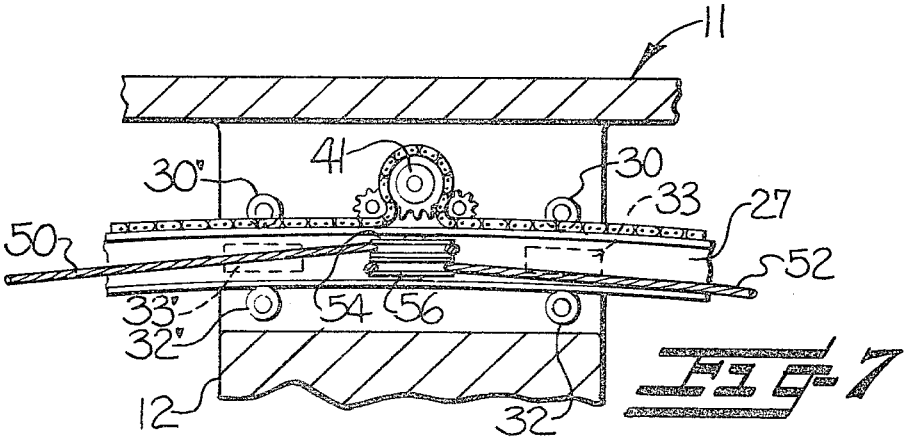
FIG. 7 is a sectional elevation view taken substantially along the line 7—7 of FIG. 5.

Means are also provided for selectively moving the boom assembly 20 laterally with respect to the central hull 11, and for maintaining a selected relative position therebetween. This moving means is best illustrated in FIG. 6, and comprises an elongate power transmission means or chain 36 which is fixed to and extends laterally along the beam 27. Manually operable sprocket means is fixed to the deck assembly, and comprises a hand wheel 38 mounted in the cockpit 15, a chain and sprocket assembly 39, a self-locking worm gear reducer 40, and a sprocket 41 which operatively engages the chain 36. A pair of idler sprockets 42, 42' are mounted to the beam 27 immediately adjacent the sprocket 41 to maintain proper engagement between the sprocket 41 and chain 36. As will be apparent from the above description, rotation of the hand wheel 38 by a crew member results in the boom assembly moving laterally along the roller assemblies. Also, the worm gear reducer 40 acts to maintain a selected relative position by precluding rotational movement from the sprocket 41 toward the hand wheel 38. Thus lateral movement of the boom assembly can be effected only by the rotation of the hand wheel, and a crew member may rotate the hand wheel in either direction to move the boom assembly in the intended direction, and he may release his hold on the hand wheel and the boom assembly will maintain its relative position with respect to the central hull.

To effect steering, a rudder 44 is pivotally mounted at the stern of the central hull 11 in the usual manner, and a tiller 46 is connected to the rudder and extends into the cockpit so as to be accessible by a member of the crew.

The means mounting the boom assembly 20 to the central hull 11 further includes a pair of cables 50, 52 which serve to limit and control canting or twisting movement between the central hull and boom assembly. The ends of each cable are fixed to the opposite outrigger hulls 24, 25 at longitudinally spaced points, which correspond to the points at which the two beams 26, 27 are fixed thereto. Thus each end of each cable 50, 52 is laterally aligned with a different one of the two beams 26, 27. Two pairs of pulleys 54, 55 and 56, 57 (see also FIG. 9) are mounted within the opening 16 along the longitudinal axis of the central hull, with the pulleys 54, 56 being mounted together on a shaft 58 for rotation about a common axis, and the pulleys 55, 57 being similarly mounted for rotation about the shaft 59. The pulleys 54, 55 engage the cable 50, and the pairs of pulleys 56, 57 engage the cable 52, so that each cable includes opposite end portions which are enclosed within the confines of opposite end portions of the two beams, and a medial portion which extends between the two beams and in a direction which has a substantial longitudinal component. Thus the two cables 50, 52 form a rigidifying somewhat X-shaped brace between the central hull and boom assembly, while permitting lateral movement therebetween.

During sailing, the boom assembly 20 may be moved laterally in the leeward direction (note FIG. 3) to result in the leeward outrigger hull 25 being moved outwardly from the central hull 11 and downwardly with respect thereto, to thereby increase the leverage and buoyancy of the leeward outrigger hull and thus minimize heeling of the sailboat. Also, the windward hull 24 will be concurrently moved in the reverse direction, and is partially lifted from the water as it moves toward the central hull, to thereby reduce any tendency of the windward hull to rotate the central hull section in the leeward direction. In this regard, the amount of curvature of the two beams 26, 27 of the boom assembly will vary depending upon the size and configuration of the sailboat. However, such curvature is by design sufficient to result in a substantial lowering of the leeward hull into the water as it is moved outwardly, to thereby achieve a significant increase in the buoyant force applied by the water to such hull.

Figure 8:
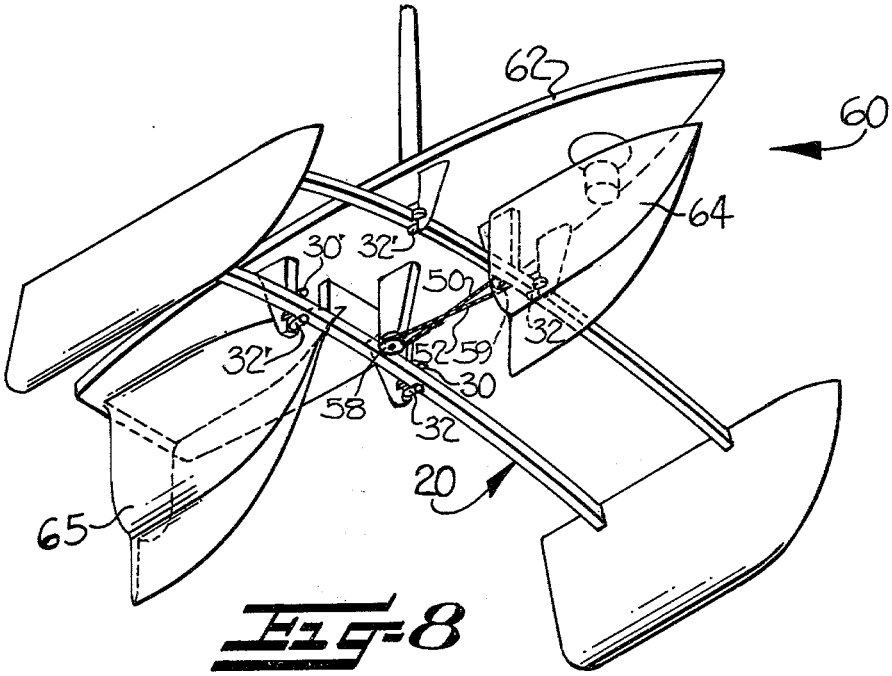
FIG. 8 is a perspective view of a second embodiment of a trimaran sailboat embodying the features of the present invention.
Figure 9:
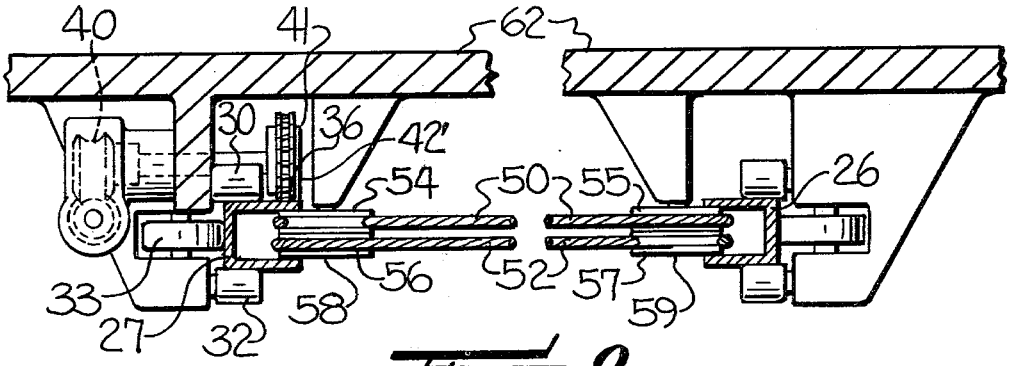
FIG. 9 is a fragmentary sectional elevation view taken substantially along the longitudinal centerline of the sailboat shown in FIG. 8.
Figure 10:
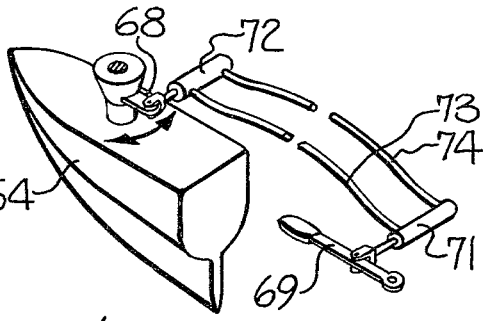
FIG. 10 is a fragmentary perspective view illustrating the steering mechanism for the forward hull section of the sailboat shown in FIG. 8.

A second embodiment of a sailboat embodying the present invention is indicated generally at 60 in FIGS. 8–10. In describing the sailboat 60, like numerals are utilized to designate elements which are common with the sailboat 10. In the sailboat 60, the central hull comprises a deck 62, and a pair of longitudinally aligned and spaced apart hull sections 64, 65 mounted to the underside of the deck. Also, as an alternative to rudder steering, the sailboat 60 has provision for effecting steering by rotation of the forward hull section 64 about a vertical axis. More particularly, the forward hull section 64 is mounted to the deck 62 for rotation about a vertical axis, and a steering mechanism is provided which includes a lever arm 68 fixed to the hull section 64 for rotation therewith about the vertical axis, and a tiller 69 pivotally mounted in the cockpit of the deck. The tiller 69 is operatively connected to the lever arm 68 by a hydraulic servo mechanism, which comprises first hydraulic cylinder 71 connected to the tiller and mounted to the deck, a second hydraulic cylinder 72 mounted to the deck and connected to the lever arm, and a pair of flexible hydraulic lines 73, 74 for interconnecting the two cylinders. As will be apparent, pivotal movement of the tiller 69 causes the lever arm 68 and thus the forward hull section 64 to correspondingly rotate about the vertical axis.

The use of two hull sections 64, 65 is seen to further provide the sailboat 60 with improved longitudinal stability. In this regard, planing type hulls are generally preferred for use with the present invention as opposed to displacement type hulls, since planing hulls have less draft, and provide less resistance to forward movement through the water. However, planing hulls tend to rise in the water as the forward speed increases, which reduces the longitudinal length of the hull which is in supporting contact with the water. This in turn reduces the longitudinal stability of the boat, and can result in "porpoising" or nosing over. The use of two hull sections 64, 65 tends to alleviate this tendency, since while each planing hull section will tend to lift in the water with speed, the longitudinal distance between the forward and aft points of support would remain substantially constant at all speeds, thereby providing improved longitudinal stability.

In the drawings and specification, there has been set forth a preferred embodiment of the invention, and although specific terms are employed, they are used in a generic and descriptive sense only and not for purposes of limitation.

That which is claimed is:

1. A trimaran sailboat characterized by the ability to limit heeling under various headings to thereby maximize the effective sail area and speed, and comprising a central hull, a mast mounted on said central hull for supporting a sail, a boom assembly comprising a boom having an arcuate curvature along its length, and an outrigger hull mounted at each end of said boom, means mounting said boom assembly laterally across said central hull and so as to permit relative lateral movement therebetween, and with the center of curvature of said boom being disposed below said central hull, said mounting means including cable means for limiting canting between said boom assembly and said central hull and comprising first and second cables fixedly interconnected between said outrigger hulls, with the ends of each cable being fixed to opposite hulls at longitudinally spaced points, and pulley means mounted on said central hull and operatively engaging each cable so that each cable includes a medial portion which extends in a direction having a substantial longitudinal component, and means for selectively moving said boom assembly laterally with respect to said central hull, whereby lateral movement of the boom assembly in the leeward direction results in the leeward outrigger hull being moved outwardly from the central hull and downwardly with respect thereto, to thereby increase the leverage and buoyancy of the leeward outrigger hull and thus minimize heeling of the sailboat.

2. The trimaran sailboat as defined in claim 1 wherein said boom comprises a pair of longitudinally spaced apart, parallel beams, and said mounting means comprises roller means mounted to said central hull and operatively contacting each of said beams to permit rolling movement therebetween.

3. The trimaran sailboat as defined in claim 1 wherein said means for moving said boom assembly comprises self-locking means for maintaining the boom assembly and central hull in a selected relative position.

4. The trimaran sailboat as defined in claim 1 wherein said means for moving said boom assembly comprises an elongate, laterally directed power transmission means fixedly mounted to said boom and extending along the length thereof, and manually operable sprocket means mounted to said central hull and operatively engaging said power transmission means, whereby operation of said sprocket means by the crew causes the boom assembly to move laterally with respect to said central hull.

5. The trimaran sailboat as defined in claim 4 wherein said sprocket means includes hand rotation means mounted for manual rotation by the crew, a sprocket engaging said power transmission means, and self-locking gear reduction means operatively interconnecting said hand rotation means and said sprocket.

6. The trimaran sailboat as defined in claim 1 wherein said central hull includes a continuous surface which is adapted to be in buoyant contact with the water along substantially the full length of said central hull.

7. The trimaran sailboat as defined in claim 6 further comprising means for steering the sailboat and comprising a rudder mounted to said central hull and tiller means operable by the crew for moving the rudder.

8. The trimaran sailboat as defined in claim 1 wherein said central hull comprises a deck, and a pair of longitudinally aligned and spaced apart hull sections mounted to the underside of said deck.

9. The trimaran sailboat as defined in claim 8 wherein at least one of said hull sections is mounted for rotation about a vertical axis, and wherein said sailboat further comprises means for steering the sailboat by selectively rotating said rotatable hull section about its vertical axis to permit steering of the sailboat.

10. The trimaran sailboat as defined in claim 1 wherein said boom has an amount of curvature which is sufficient to result in a substantial lowering of the leeward hull into the water as it is moved outwardly, so as to achieve a significant increase in the buoyant force applied by the water to such hull.

* * * * *